US006016724A

United States Patent [19]

Janton

[11] Patent Number: 6,016,724

[45] Date of Patent: Jan. 25, 2000

[54] PIVOTABLE SOCKET ATTACHMENT FOR A SOCKET WRENCH

[76] Inventor: Walter M. Janton, 222 McClelland Ave., Bellmawr, N.J. 08031

[21] Appl. No.: 09/007,411

[22] Filed: Jan. 15, 1998

[51] Int. Cl.[7] ..... B25B 13/00; B25B 23/16

[52] U.S. Cl. ..... 81/124.6; 81/177.7

[58] Field of Search ..... 81/124.6, 177.8, 81/177.9, 177.7, 177.75

[56] References Cited

FOREIGN PATENT DOCUMENTS 212685 10/1959 France ..... 81/177.7

1390926 4/1975 United Kingdom ..... 81/177.8

*Primary Examiner*—David A. Scherbel

*Assistant Examiner*—Philip J. Hoffmann

[57] ABSTRACT

A pivoting socket wrench socket attachment is provided including a socket wrench with an outboard end including at least one a detent formed therein. A socket attachment includes an inboard face, an outboard face, and a periphery formed therebetween. The outboard face has a bore formed therein for attachment with at least one of a nut and a bolt. An inboard face is provided including an opening defined by at least one face with an indent formed therein for engaging the detent of the socket wrench. The open is further adapted to allow the pivoting of the socket attachment with respect to the socket wrench about an axis which intersects the detent and indent.

17 Claims, 2 Drawing Sheets

10
12
14
16
18
20
22
23
24
3
4

PIVOTABLE SOCKET ATTACHMENT FOR A SOCKET WRENCH

BACKGROUND OF THE INVENTION

1. Field of the Invention

The present invention relates to socket wrench systems and more particularly pertains to a new pivotable socket attachment for a socket wrench for providing a socket attachment which is removable and pivotable with respect to a socket wrench.

2. Description of the Prior Art

The use of socket wrench systems is known in the prior art. More specifically, socket wrench systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art socket wrench systems include U.S. Pat. No. 5,386,746; U.S. Pat. No. 4,932,293; U.S. Pat. No. 4,607,547; U.S. Pat. No. 4,798,108; U.S. Pat. Des. 274,881; and U.S. Pat. Des. 246,415.

In these respects, the pivotable socket attachment for a socket wrench according to the present invention substantially departs from the conventional concepts and designs of the prior art, and in so doing provides an apparatus primarily developed for the purpose of providing a socket attachment which is removable and pivotable with respect to a socket wrench.

SUMMARY OF THE INVENTION

In view of the foregoing disadvantages inherent in the known types of socket wrench systems now present in the prior art, the present invention provides a new pivotable socket attachment for a socket wrench construction wherein the same can be utilized for providing a socket attachment which is removable and pivotable with respect to a socket wrench.

The general purpose of the present invention, which will be described subsequently in greater detail, is to provide a new pivotable socket attachment for a socket wrench apparatus and method which has many of the advantages of the socket wrench systems mentioned heretofore and many novel features that result in a new pivotable socket attachment for a socket wrench which is not anticipated, rendered obvious, suggested, or even implied by any of the prior art socket wrench systems, either alone or in any combination thereof.

To attain this, the present invention generally comprises a socket wrench with an outboard end having a constant square cross-section. Such outboard end is defined by four equally sized rectangular side faces and a square end face, as shown in FIG. 1. An opposed pair of the side faces each include a spring biased detent formed therein for reasons that will soon become apparent. It should be noted that the detent is situated at a central extent of the associated side face and a common predetermined distance from the end face of the outboard end. Next provided is a socket attachment having a cylindrical configuration with a circular inboard face, a circular outboard face, and a tubular periphery formed therebetween. The outboard face has a cylindrical bore formed therein through about ⅓ a length of the socket attachment. An interior periphery of the cylindrical bore is equipped with a plurality of longitudinally extending ridges each having a constant triangular cross-section. See FIG. 4. The inboard face includes an opening with a top extent having a generally rectangular configuration. Such opening is defined by three closed side faces, a bottom face and an open side face formed in the periphery of the socket attachment. As shown in FIGS. 2 & 3, an opposed pair of the closed side faces of the top extent include a pair of indents formed therein. The indents are spaced the predetermined distance from the bottom face and define a line which intersects a central axis of the socket attachment. The opening of the inboard face further includes a bottom extent with a width equal to that of the top extent. The bottom extent is defined by a bottom face which has a planar upper portion extending downwardly from the bottom face of the top extent. Such upper portion extends downwardly at a first predetermined angle and has a first predetermined length. Associated therewith is a planar lower portion extending downwardly from the upper portion of the bottom face of the bottom extent at a second predetermined angle twice that of the first predetermined angle. The lower portion further has a second predetermined length three times that of the first predetermined length. The bottom extent thus has an open side face which is in communication with that of the top extent. The open side face of the bottom extent extends downwardly from the open side face of the top extent with a common width for defining an augmented open side face. This augmented side face is equipped with a width equal to at least ½ a diameter of the socket attachment and a length equal to ⅔ that of the socket attachment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pivotable socket attachment for a socket wrench apparatus and method which has many of the advantages of the socket wrench systems mentioned heretofore and many novel features that result in a new pivotable socket attachment for a socket wrench which is not anticipated, rendered obvious, suggested, or even implied by any of the prior art socket wrench systems, either alone or in any combination thereof.

It is another object of the present invention to provide a new pivotable socket attachment for a socket wrench which may be easily and efficiently manufactured and marketed.

It is a further object of the present invention to provide a new pivotable socket attachment for a socket wrench which is of a durable and reliable construction.

An even further object of the present invention is to provide a new pivotable socket attachment for a socket wrench which is susceptible of a low cost of manufacture with regard to both materials and labor, and which accordingly is then susceptible of low prices of sale to the consuming public, thereby making such pivotable socket attachment for a socket wrench economically available to the buying public.

Still yet another object of the present invention is to provide a new pivotable socket attachment for a socket wrench which provides in the apparatuses and methods of the prior art some of the advantages thereof, while simultaneously overcoming some of the disadvantages normally associated therewith.

Still another object of the present invention is to provide a new pivotable socket attachment for a socket wrench for providing a socket attachment which is removable and pivotable with respect to a socket wrench.

Even still another object of the present invention is to provide a new pivotable socket system that includes a socket wrench with an outboard end including at least one a detent formed therein. A socket attachment includes an inboard face, an outboard face, and a periphery formed therebetween. The outboard face has a bore formed therein for attachment with at least one of a nut and a bolt. An inboard face is provided including an opening defined by at least one face with an indent formed therein for engaging the detent of the socket wrench. The open is further adapted to allow the pivoting of the socket attachment with respect to the socket wrench about an axis which intersects the detent and indent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
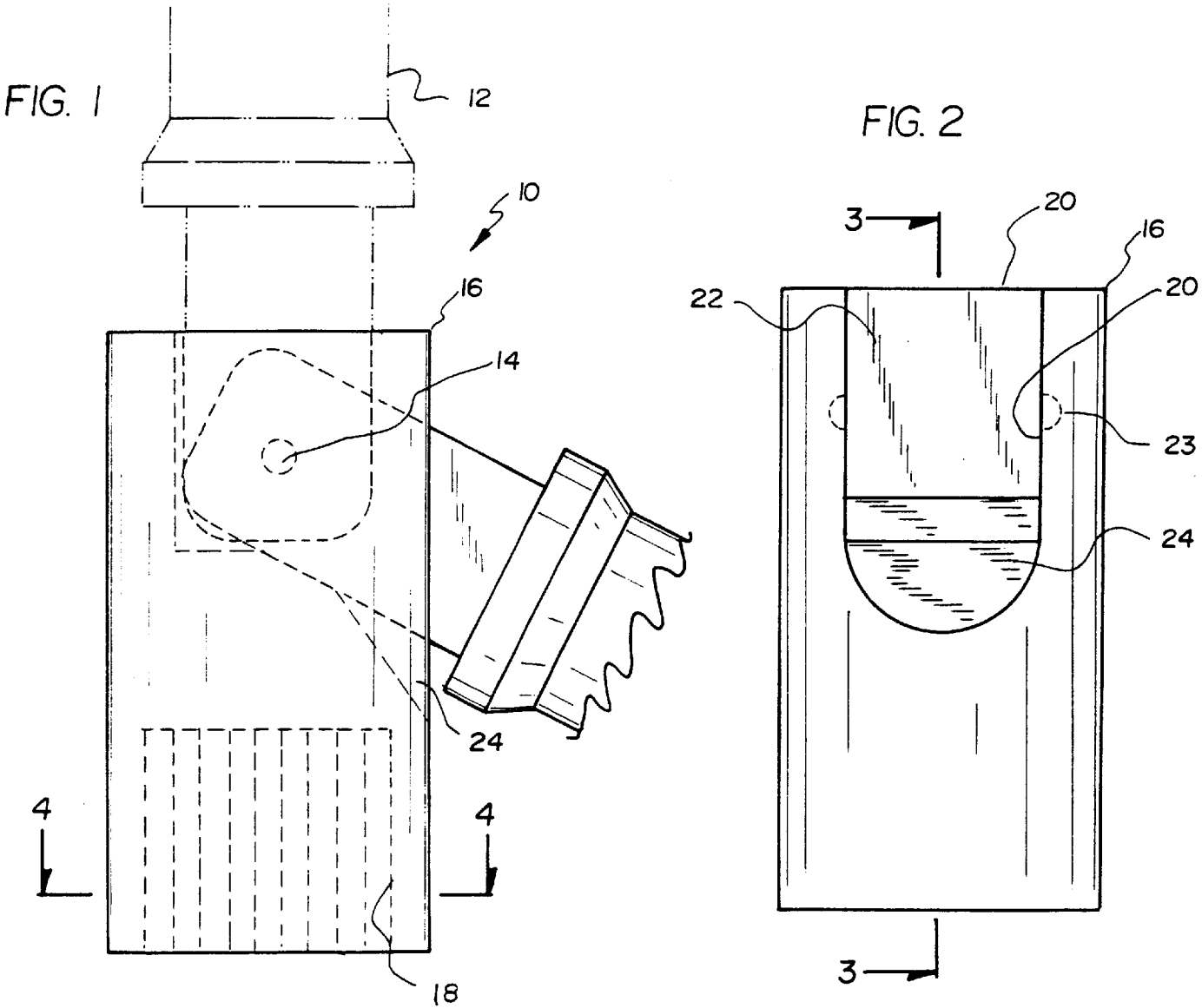
FIG. 1 is a side view of a new pivotable socket attachment for a socket wrench according to the present invention.
FIG. 2 is a side view of just the socket attachment of the present invention.
Figure 4:
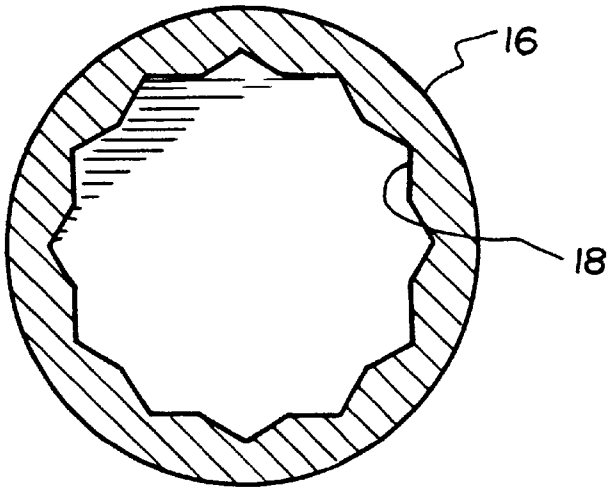
FIG. 4. is an end view of the outboard end of the socket attachment of the present invention.

With reference now to the drawings, and in particular to FIGS. 1 through 4 thereof, a new pivotable socket attachment for a socket wrench embodying the principles and concepts of the present invention and generally designated by the reference numeral 10 will be described.

The present invention, designated as numeral 10, includes a socket wrench 12 with an outboard end having a constant square cross-section. Such outboard end is defined by four equally sized rectangular side faces and a square end face, as shown in FIG. 1. An opposed pair of the side faces each include a spring biased detent 14 formed therein for reasons that will soon become apparent. It should be noted that the detent is situated at a central extent of the associated side face and a common predetermined distance from the end face of the outboard end.

Next provided is a socket attachment 16 having a cylindrical configuration with a circular inboard face, a circular outboard face, and a tubular periphery formed therebetween. The outboard face has a cylindrical bore 18 formed therein through about ⅓ a length of the socket attachment. An interior periphery of the cylindrical bore is equipped with a plurality of longitudinally extending ridges each having a constant triangular cross-section. See FIG. 4.

Figure 3:
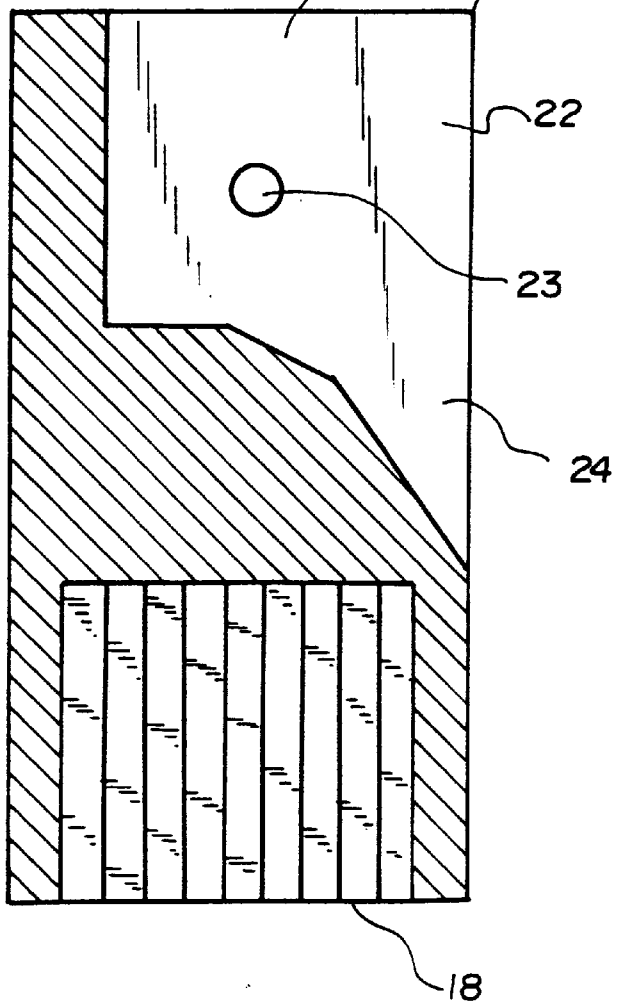
FIG. 3 is a side cross-sectional view of the present invention taken along line 3—3 shown in FIG. 2.

The inboard face includes an opening 20 with a top extent 22 having a generally rectangular configuration. Such opening is defined by three closed side faces, a bottom face and an open side face formed in the periphery of the socket attachment. As shown in FIGS. 2 & 3, an opposed pair of the closed side faces of the top extent include a pair of indents 23 formed therein. The indents are spaced the predetermined distance from the bottom face and define a line which intersects a central axis of the socket attachment.

The opening of the inboard face further includes a bottom extent 24 with a width equal to that of the top extent. The bottom extent is defined by a bottom face which has a planar upper portion extending downwardly from the bottom face of the top extent. Such upper portion extends downwardly at a first predetermined angle and has a first predetermined length. Associated therewith is a planar lower portion extending downwardly from the upper portion of the bottom face of the bottom extent at a second predetermined angle twice that of the first predetermined angle. The lower portion further has a second predetermined length three times that of the first predetermined length. As an option, the bottom extent may be formed of a single planar surface which extends downwardly at a constant angle.

The bottom extent thus has an open side face which is in communication with that of the top extent. The open side face of the bottom extent extends downwardly from the open side face of the top extent with a common width for defining an augmented open side face. This augmented side face is equipped with a width equal to at least ½ a diameter of the socket attachment.

By this structure, the outboard end of the socket wrench is removably and pivotally coupled within the opening of the inboard face of the socket attachment. As such, the socket wrench is adapted to pivot between a first orientation in coaxial alignment with the socket attachment and a second orientation forming up to a 135 degree angle therewith. In an alternate embodiment, the socket wrench is adapted to pivot 90 degrees.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pivoting socket wrench socket attachment comprising, in combination:

a socket wrench with an outboard end including at least one detent formed therein;

a socket attachment having an inboard face, an outboard face, and a periphery formed therebetween, the outboard face having a bore formed therein for attachment with at least one of a nut and a bolt;

said inboard face including an opening defined by at least one face with an indent formed therein for engaging the detent of the socket wrench and adapted to allow the pivoting of the socket attachment with respect to the socket wrench about an axis which intersects the detent and indent; and wherein the opening of the inboard face of the socket attachment includes only a single open side face.

2. A pivoting socket wrench socket attachment as set forth in claim 1 wherein the socket wrench pivots within a single plane.

3. A pivoting socket wrench socket attachment as set forth in claim 1 wherein socket wrench pivots about a range of up to 135 degrees.

4. A pivoting socket wrench socket attachment as set forth in claim 1 wherein the socket wrench is adapted to only pivot between a first orientation in coaxial alignment with the socket attachment and a second orientation forming an obtuse angle therewith.

5. A pivoting socket wrench socket attachment as set forth in claim 1 wherein the opening of the inboard end of the socket attachment includes a top extent with a rectangular configuration and an angled bottom extent.

6. A pivoting socket wrench socket attachment as set forth in claim 1 wherein the detent is spring biased.

7. A pivoting socket wrench socket attachment as set forth in claim 1 wherein a pair of detents and indents are included.

8. A pivoting socket wrench socket attachment as set forth in claim 1 wherein the socket wrench is removably coupled to the socket attachment.

9. A pivoting socket wrench socket attachment comprising, in combination:

a socket wrench with an outboard end including at least one detent formed therein;

a socket attachment having an inboard face, an outboard face, and a periphery formed therebetween, the outboard face having a bore formed therein for attachment with at least one of a nut and a bolt;

said inboard face including an opening having a top extent defined by a plurality of closed side faces, a bottom face and only an open side face formed in the periphery of the socket attachment, at least one of the closed side faces having an indent formed therein for engaging the detent of the socket wrench and adapted to allow the pivoting of the socket attachment with respect to the socket wrench about an axis which intersects the detent and indent; and said opening of the inboard face further including a bottom extent defined by a bottom face which has a planar upper portion extending downwardly from the bottom face of the top extent at a first predetermined angle, the bottom face further having a planar lower portion extending downwardly from the upper portion of the bottom face of the bottom extent at a second predetermined angle greater than that of the first predetermined angle, wherein the bottom extent has an open side face which is in communication with that of the top extent and extends downwardly from the open side face of the top extent for defining an augmented open side face.

10. A pivoting socket wrench socket attachment as set forth in claim 9 wherein the socket wrench pivots within a single plane.

11. A pivoting socket wrench socket attachment as set forth in claim 9 wherein socket wrench pivots about a range of up to 135 degrees.

12. A pivoting socket wrench socket attachment as set forth in claim 9 wherein the socket wrench is adapted to only pivot between a first orientation in coaxial alignment with the socket attachment and a second orientation forming an obtuse angle therewith.

13. A pivoting socket wrench socket attachment as set forth in claim 9 wherein the top extent has a rectangular configuration.

14. A pivoting socket wrench socket attachment as set forth in claim 9 wherein the detent is spring biased.

15. A pivoting socket wrench socket attachment as set forth in claim 11 wherein a pair of detents and indents are included.

16. A pivoting socket wrench socket attachment as set forth in claim 9 wherein the socket wrench is removably coupled to the socket attachment.

17. A pivoting socket wrench socket attachment comprising, in combination:

a socket wrench with an outboard end having a constant square cross-section defined by four equally sized rectangular side faces and a square end face, an opposed pair of the side faces each including a spring biased detent formed therein at a central extent thereof and each a common predetermined distance from the end face of the outboard end;

a socket attachment having a cylindrical configuration with a circular inboard face, a circular outboard face, and a tubular periphery formed therebetween, the outboard face having a cylindrical bore formed therein through about ⅓ a length of the socket attachment with an interior periphery having a plurality of longitudinally extending ridges each having a constant triangular cross-section;

said inboard face including an opening with a top extent with a generally rectangular configuration and defined by three closed side faces, a bottom face and an open side face formed in the periphery of the socket attachment, an opposed pair of the closed side faces of the top extent including a pair of indents formed therein the predetermined distance from the bottom face and defining a line which intersects a central axis of the socket attachment;

said opening of the inboard face further including a bottom extent with a width equal to that of the top extent, the bottom extent defined by a bottom face which has a planar upper portion extending downwardly from the bottom face of the top extent at a first predetermined angle and having a first predetermined length, the bottom face further having a planar lower portion extending downwardly from the upper portion of the bottom face of the bottom extent at a second predetermined angle twice that of the first predetermined angle and having a second predetermined length three times that of the first predetermined length, wherein the bottom extent has an open side face which is in communication with that of the top extent and extends downwardly from the open side face of the top extent with a common width for defining an augmented open side face with a width equal to at least ½ a diameter of the socket attachment and a length equal to ⅔ that of the socket attachment;

whereby the outboard end of the socket wrench is pivotally coupled within the opening of the inboard face of the socket attachment such that the same is adapted to pivot between a first orientation in coaxial alignment with the socket attachment and a second orientation forming a 135 degree angle therewith.

* * * * *